United States Patent [19]

Burdick

[11] Patent Number: 4,758,694

[45] Date of Patent: Jul. 19, 1988

[54] PUSH-PUSH TYPE SWITCH WITH TACTILE FEEDBACK

[75] Inventor: Robert C. Burdick, Romulus, Mich.

[73] Assignee: United Technologies Automotive, Inc., Dearborn, Mich.

[21] Appl. No.: 69,064

[22] Filed: Jul. 2, 1987

[51] Int. Cl.[4] ..... H01H 9/20; H01H 13/56; H01H 19/36

[52] U.S. Cl. ..... 200/50 C; 200/5 E; 200/6 B; 200/68.1; 200/70

[58] Field of Search ..... 200/6 R, 6 B, 11 K, 200/11 G, 67 R, 67 D, 68.1–68.3, 70, 76, 153 G, 153 L, 153 J, 159 R, 160, 5 E, 50 C

[56] References Cited

U.S. PATENT DOCUMENTS

| | | | |
|---|---|---|---|
| 1,448,033 | 3/1923 | Nelson | 200/68.1 |
| 2,085,539 | 6/1937 | Morris | 200/11 K |
| 2,285,916 | 6/1942 | Eisner | 200/6 B |
| 2,321,212 | 6/1943 | Johnson | 200/6 B |
| 2,446,789 | 8/1948 | Schmid | 200/6 R |
| 2,524,410 | 10/1950 | Trainor | 200/67 D |
| 2,529,970 | 11/1950 | Schmid | 200/70 |
| 2,647,180 | 7/1953 | Tregoning, Sr. | 200/68.1 |
| 2,994,750 | 8/1961 | Raab | 200/67 R |
| 3,045,082 | 7/1962 | Mason | 200/68.1 |
| 4,300,026 | 11/1981 | Bull | 200/153 J |
| 4,692,573 | 9/1987 | Fukuyama et al. | 200/153 J X |

*Primary Examiner*—J. R. Scott

[57] ABSTRACT

A push-push type alternate action latching switch having low displacement and providing tactile feedback. The switch includes a push button actuator (80), a contact carrier (40) which is caused to rotate creating motion in a direction perpendicular to the direction of the push button, and a cycler (60) for effecting the desired motion are disclosed. The tactile feel is provided by displacing a terminal (34) over an extending detent rib (26) as it changes between switch positions. Low displacement is created by the translation of the in-out motion to the left-right motion to obtain the desired switching effect. A pair of interlocked push-push type alternate action latching switches is also disclosed.

17 Claims, 5 Drawing Sheets

PUSH-PUSH TYPE SWITCH WITH TACTILE FEEDBACK

TECHNICAL FIELD

The field to which this invention pertains is the field of electrical switches and, specifically, the field of push-push type latching switches which provide the operator with tactile feedback while having extremely low travel.

BACKGROUND OF INVENTION

The present invention is directed to a push-push type latching switch wherein the first push by an operator on a push button changes the switch from the first state to a second state, and the switch is latched in the second state. The second push by the operator changes the switch from the second state to the first state and the switch is then latched in the first state. For this type of push-push operation, it has been found that the tactile feel or feedback to the operator as the switch is displaced is important in providing a high technology response which is readily marketable. It is additionally found to be important to provide an extremely low displacement such that the operation of the button only requires making momentary contact. The use of low displacement with a latching switch has been found particularly suitable for customer acceptance and other marketing reasons.

Previous push-push type switches have often used various camming and other arrangements to achieve the desired switching and latching operation. Previous designs have been utilized to what is commonly referred to as the "heart-in-heart" design wherein heart shaped cams are utilized to control the positioning of the switch actuator or switch contactor. However, this type of switch requires overtravel by the actuator to achieve the switching.

Other prior art devices have converted in-out push button displacement into left-right direction displacement to achieve appropriate motion between electrical contacts distinct from the in-out motion of the push button. U.S. Pat. No. 4,300,026 discloses a switch assembly wherein a plunger engages a pivotably supported member to displace electrical contacts in a left-right direction while the push button is moved in the in-out direction. U.S. Pat. No. 3,045,482 discloses another push button switch wherein a contact carrier is displaced in the left-right direction by operation of a push button in an in-out direction through a limited loss motion connection.

U.S. Pat. No. 2,994,750 discloses a snap acting switch having a pivotably mounted carrier which is snapped in the opposite direction about its pivot axis by a trip lever adapted to alternatively engage spaced seats in the carrier in response to push button displacement.

The herein invention provides a push-push type latching switch having the smallest displacement of any known switch commercially available of this type. Initial samples indicate that positive switching and latching may be obtained with an in-out displacement of the push button of only 40 thousandths of an inch (0.040 inches). Notwithstanding this small displacement, tactile feedback to the operator is additionally provided as a result of the mechanical displacement of contacts over a detent ridge separating the first position of a switch from a second position of the switch.

Furthermore, the herein described switch may be used in pairs and have a cross cancelling feature such that if one of the pair of switches is in the "on" position, then when the other switch is placed in the "on" position, the first switch is placed automatically in the "off" position. If the first switch is in the "off" position, switching of the second switch does not affect the position of the first switch.

SUMMARY OF THE INVENTION

It is an object of the present invention to provide a push-push type latching switch with tactile feedback and low in-out travel.

It is a further object of the present invention to provide a push-push type switch wherein in-out push motion results in left to right contact motion to achieve the desired switching result.

It is a yet further object of the present invention to provide a push-push type latching switch which may be assembled from a series of relatively inexpensive components and if combined in pairs may be cross cancelling.

It is a still further object of the present invention to provide a safe, economical, reliable, easy to assemble and manufacture switch.

Additional objects will be apparent from the description to follow and the appended claims.

The above objects are achieved according to a preferred embodiment of the present invention by the provision of a push-push type switch. The switch includes a housing having a bottom portion with electrical contacts separated by a detent rib, a contactor mounted to a carrier for making electrical connections with the contacts, said contactor having a terminal which is located on one side of the detent rib when the switch is in a first position and the other side of the detent rib when the switch is in a second position; wherein said carrier includes an axle which may be mounted to the housing to secure the carrier for rotational movement, a deflecting means including at least one face angled from a radius extending from the axle, and an extending alignment post means spaced from the axle; a cycler mounted within the enclosure and including an extending deflecting post positioned to engage the deflecting means of the carrier as the cycler is displaced causing the carrier to rotate about the axle and the contactor to traverse the detent rib to be displaced between the first position and the second position of the switch; and an actuator mounted for sliding movement and including biasing means for urging the actuator to its at rest position, said actuator including a push button and defining a slot for the receipt of the cycler, whereby displacement of the actuator causes displacement of the cycler.

Additionally, there is disclosed that the cycler may have a pair of spring arms which coact with the alignment posts extending from the carrier such that displacement of the carrier creates a bias by displacing one of the spring arms of the cycler. Thereafter, upon release of the actuator such that the deflecting post is disengaged from the deflecting means, the bias created in the spring arm of the cycler acts to slidably displace the cycler to place the deflecting post in a separate position for engaging a different face of the deflecting means for effecting displacement of the carrier in the opposite rotational direction.

Also disclosed is a push-push type switch having a housing, a minimum displacement to operate the switch, and for providing the operator with tactile feedback including an actuator having a push button mounted relative to the housing for in-out sliding displacement. A cycler is mounted to the actuator for in-out sliding displacement with the actuator, and is mounted to allow left-right sliding displacement relative to the actuator. A carrier is mounted to the housing for rotational displacement between a first position and a second position, said carrier including deflecting means having a pair of faces each angled from the in-out displacement direction, and said cycler including a deflecting post for engaging one face of the deflecting means upon a sliding displacement of the actuator, said motion causing the carrier to rotate from a first position to a second position.

Further disclosed is a low displacement push-push type switch having a housing and an actuator including a push button mounted for low displacement in a sliding motion within the housing, a contactor mounted to a carrier for being displaced in a left-right direction across a detent to effect switching between a first position and a second position, and means for translating low displacement in-out motion to a larger displacement left-right motion to effect switching, said means allowing for tactile feedback to the operator while having low displacement in-out motion.

PREFERRED EMBODIMENT OF THE INVENTION

The push-push type latching switch as described herein will have specific components for effecting various sliding and other displacement motions. It is to be understood that although these components will be described in specific detail, components having similar structure and providing a similar function may be utilized to achieve the same result.

Figure 1:
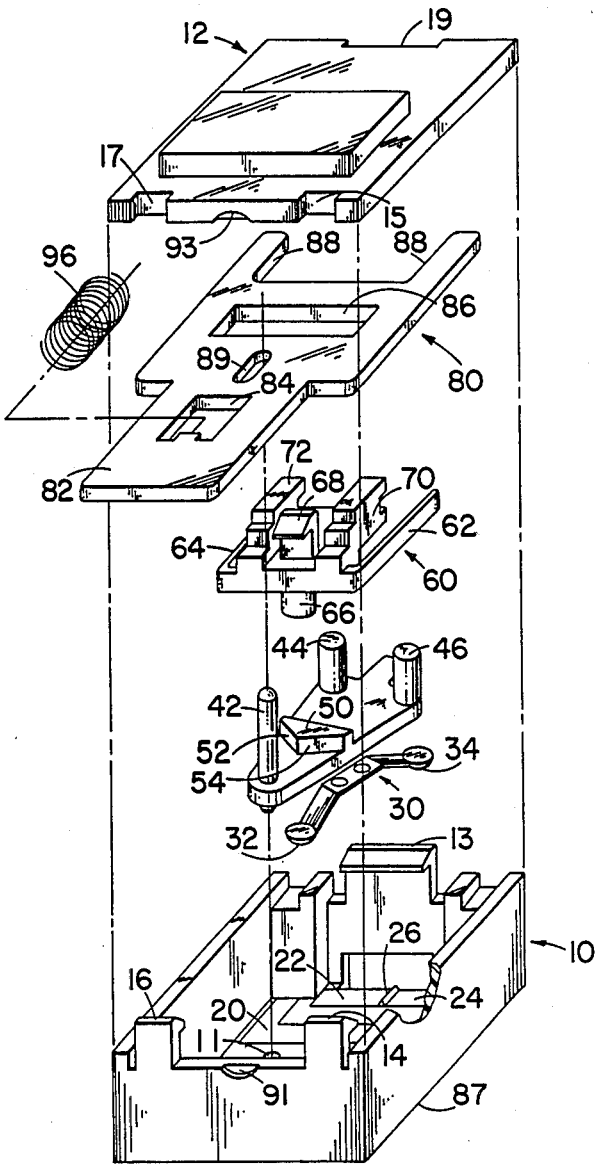
FIG. 1 is an exploded view of the push-push type switch.

It is further to be understood that although this invention is shown having a series of three electrical contacts, that switch could be equally used as an "on" and "off" switch with two electrical contacts and other design modifications can be made within the spirit and scope of the invention herein. Additionally as used throughout the specification, the in-out and left-right motions will be as shown in FIG. 1. The "in" motion direction will be the direction of displacement when the push button is pushed to actuate the switch. The "out" motion direction will be the direction the actuator moves when the push button is released and is the direction of motion opposite the "in" motion. The left direction motion will be motion in the direction to the left as one faces the front of the switch and the right direction motion will be motion in the direction to the right again facing the front of the switch.

Referring now to FIG. 1, there may be seen a perspective exploded view of the entire switch. A housing 10 including extending legs 14, 16, and 13 cooperates with leg slots 15, 17, and 19 defined by cover 12. The housing and cover together define an enclosure within which the other components of the switch are secured. The bottom of housing 87 has electrical conductor paths thereon. These paths are shown as electrical contact A (20), electrical contact B (22), and electrical contact C (24). Detent rib 26 extends upwardly separating electrical contact B from electrical contact C.

Actuator 80 is mounted within the housing for sliding displacement in the in-out direction. Actuator 80 includes push button 82 which is that portion of the actuator to which manual force is applied to create the "in" direction motion. Spring 96 is positioned in spring slot 84 and abuts against one face of a spring slot in push button 82 of actuator 80 and spring slot 93 of cover 12 and spring slot 91 of housing 10. In this manner, the spring 96 acts to cause the "out" motion displacement of actuator 80.

Actuator 80 additionally includes an axle slot 89 through which axle 42 of carrier 40 is positioned. Axle slot 89 is a sufficient length to allow the actuator to travel in the in-out direction while the axle is fixed. Actuator 80 additionally includes hook slot 86 into which portions of cycler 60 are secured. Hook slot 86 is of sufficient dimension in the in-out direction to secure the cycler such that the cycler is displaced with the actuator in an in-out direction. However, hook slot 86 is of sufficient left-right dimension that when cycler 60 is mounted within hook slot 86, the cycler is capable of sliding displacement in the left-right direction. The actuator additionally defines guide slots 88 at the back thereof.

Cycler 60 is shown having hook 68 and guides 70 and 72. Hook 68 extends through hook slot 86 to engage the top of actuator 80. Guides 70 and 72 likewise extend such that slots formed therein engage actuator 80 at the rear of hook slot 86 to secure the cycler within hook slot 86 such that the cycler is affixed to be displaced in the in-out direction with actuator 80.

Spring arms 62 and 64 are mounted to extend from the sides of cycler 60 and are located such that they may be individually displaced in a left-right direction to create a bias in the displaced spring arm. Deflecting post 66 extends downwardly from the bottom of cycler 60 and is preferably elliptical in configuration.

Carrier 40 is shown having contactor 30 including terminals 32 and 34 mounted thereto. Terminal 32 is positioned to always engage electrical contact A. Terminal 34 is affixed to contactor 30 and is displaced with displacement of carrier 40 to travel between electrical contact B and electrical contact C. Hence, it is terminal 34 that rides over detent rib 26 as the switch alternates from a first position where terminal 34 engages electrical contact B to a second position where terminal 34 engages electrical contact C. In either position, the contactor acts to provide electric current path between electrical contact A, and either electrical contact B, or electrical contact C, depending upon the position of the carrier and the contactor affixed thereto.

Carrier 40 includes axle 42 extending upwardly and downwardly therefrom. Axle 42 is mounted in opening 11 in housing 10 at the bottom and in a corresponding opening (not shown) in cover 12. Axle 42 additionally extends through axle slot 89 of actuator 80. The carrier is, in this manner, fixedly secured within the housing to the axle such that the carrier may be rotatably displaced, but may not be displaced in sliding in-out or left-right motion. However, the rotational displacement of the carrier about the axle may result in the terminals of contactor 30 and, specifically, terminal 34 being displaced in the left-right direction.

Carrier 40 additionally includes deflecting block 50 having faces 52 and 54. Deflecting block 50 is positioned to be engaged by deflecting post 66 extending downwardly from cycler 60. Faces 52 and 54 of the deflecting block are each angled away from a radius extending from axle 42. Each face is appropriately angled such that contact of deflecting post 66 with the face causes relative rotational motion by the carrier about the axle. The faces are appropriately positioned such that contact by the deflecting post on one face or the other causes the carrier to rotate in the opposite direction.

Alignment posts 44 and 46 are shown extending upwardly from the top surface of carrier 30. These alignment posts are appropriately positioned such that spring arms 62 and 64 are contacted by the alignment post as the carrier is rotated. Hence, in this manner as carrier 40 is rotated, alignment post 46, for example, may contact and displace spring arm 62 to create a bias to cause cycler 60 to slide in the left-right direction within hook slot 86.

Figure 2:
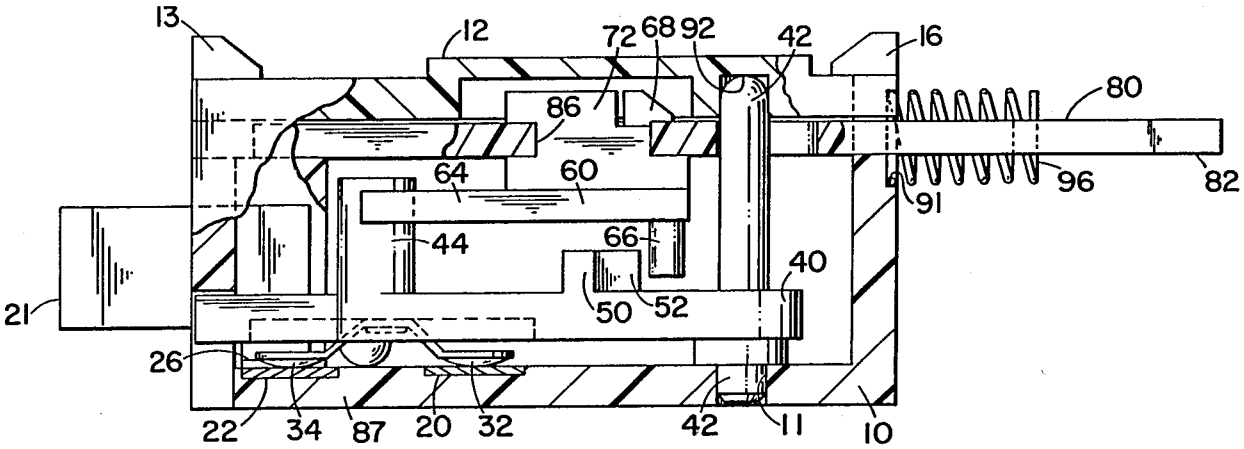
FIG. 2 is a cutaway, partially sectioned side view of the push-push type switch.

Referring now to FIG. 2, the interaction of the various components may more specifically be seen. In FIG. 2, it can be seen that housing 10 including bottom of housing 87 and cover 12 collectively define an enclosure in which all the other components are secured. Starting from the bottom, we see that axle 42 of carrier 40 secures the carrier for pivotable rotation about a point fixed relative to the housing. Axle 42 is secured within opening 11 in housing 10 and spring slot 91 of cover 12. Deflecting block 50 and face 52 are likewise shown extending from carrier 40 as is alignment post 44. Contactor 30 is shown secured to the bottom of carrier 40. The contactor may be secured by rivets, adhesive, or any other suitable means for maintaining the contactor to the carrier. Typically, the contactor may be made from a conductive material while the carrier is made from a nonconductive dielectric material, such as plastic. Terminal 32 is shown positioned in engagement with electrical contact 20. Terminal 34 is shown in engagement with electrical contact 22 which is connected to terminal 21. Detent rib 26 may be seen extending upwardly behind terminal 34 such that when the carrier is rotated, the terminal must be displaced over detent rib 26 to be moved from the first position to the second position. Electrical contact 20 is likewise shown extending beyond the housing such that an appropriate electrical connection may be made thereto.

Cycler 60 is shown mounted within hook slot 86 of actuator 80. Cycler 60 has elliptical deflecting post 66 extending downwardly therefrom and shown in position to engage face 52 of deflecting block 50 of the carrier. Additionally, cycler 60 has guides 72 extending upwardly and having a slot in which a portion of the actuator is received. Additionally, hook 68 of cycler 60 is shown engaging another portion of the actuator adjacent the hook slot such that the cycler is maintained in position. It may be seen in FIG. 2 that the cycler has a relatively snug fit with actuator 80 in the in-out direction such that as actuator 80 is displaced in the in-out direction, cycler 60 will be likewise displaced in the in-out direction. What is not apparent in FIG. 2 is that cycler 60 may be slid in the left-right direction (into and out from the paper as shown in FIG. 2) within hook slot 86. Spring arm 64 shown extending from cycler 60 and engaging alignment post 44. Legs 16 and 13 of the housing are shown extending over the cover to hold the enclosure together. Spring 96 is shown positioned to displace actuator button 82 and actuator 80 after the actuator has been moved in the "in" direction.

Figure 7:
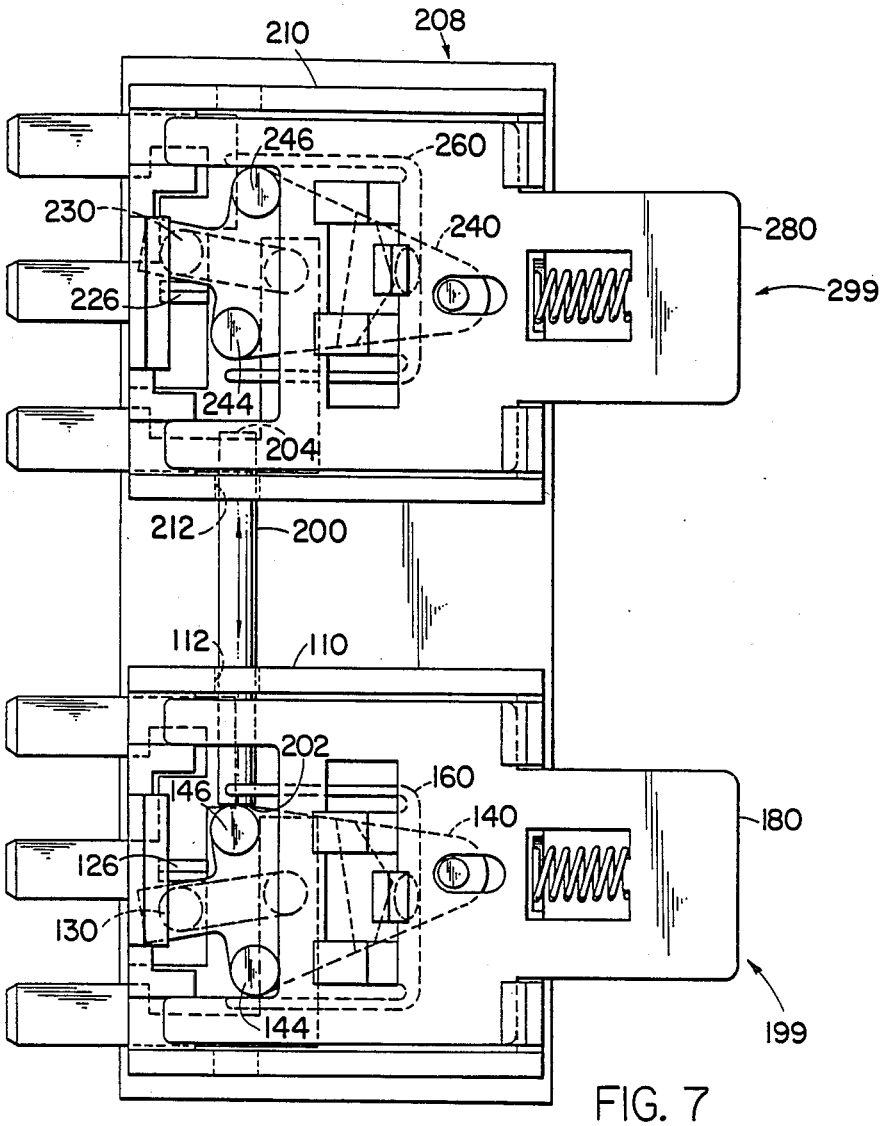
FIG. 7 is a partial top view of side by side switches having a cross cancelling feature.

Referring now to FIG. 7, there may be seen a pair of switches (199, 299) both mounted to switch mounting bracket 208 in a side by side relationship to allow for cross cancelling. Switch 199 includes housing 110, contactor 130, carrier 140, cycler 160 and actuator 180. Alignment posts 144 and 146 are mounted to carrier 140. Detent 126 is shown to the right of contactor 130 and switch 199 is in the "off" position. Switch 299 has the same parts as switch 199 referenced with the same reference numerals plus "100".

The additional elements present to provide for cross cancelling are pushrod 200 having end faces 202 and 204 and opening 112 in housing 110 together with opening 212 in housing 210. End face 202 is shown in contact with alignment post 146. End face 204 is shown spaced from, but capable of contact with, alignment post 244. Pushrod 200 is mounted for sliding, reciprocating motion within openings 112 and 212.

Both switches 199 and 299 are shown in the "off" position. Should switch 199 be placed in the "on" position, carrier 140 will rotate in a clockwise direction causing alignment post 146 to displace pushrod 200 to the right. Since switch 299 is in the "off" position, this displacement has no effect thereon. If switch 299 were in the "on" position, then this displacement would cause pushrod 200 to contact alignment post 244 to displace the carrier in a clockwise direction changing switch 299 from the "on" position to the "off" position. Switching switch 299 to the "on" position will provide similar cross cancelling contact via pushrod 200 with switch 199. Hence, if one switch is in the "on" position, then placing the other switch in the "on" position will cause the first switch to change to the "off" position.

Operation

The operation of the various components will now be described relative to FIGS. 3–6. These Figures are a series of partial top views of the switch showing the critical components.

Figure 3:
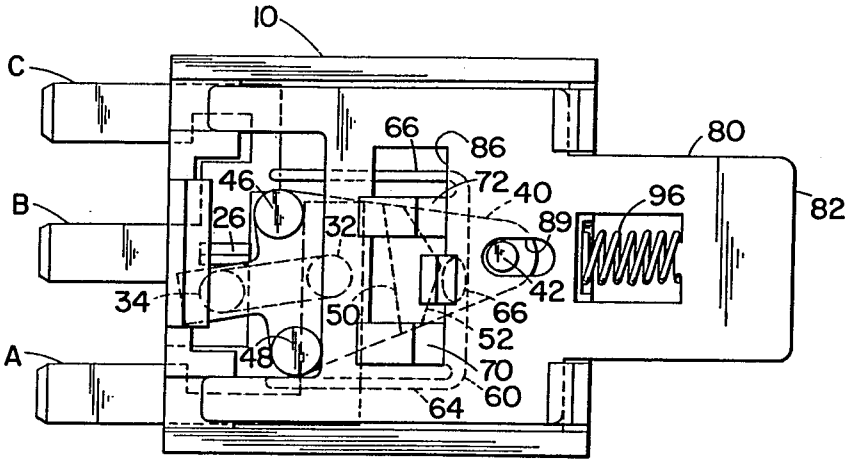
FIG. 3 is a partial top view of the switch in the first position at rest position.
Figure 4:
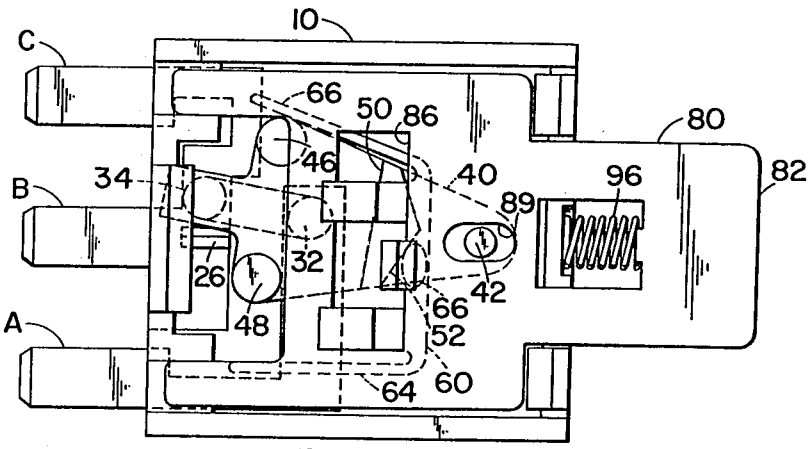
FIG. 4 is a partial top view of the switch in the first position full-in position.

Referring first to FIG. 3, the switch may be seen in the first position at rest position with terminal 34 in the first position. In this position, it may be seen that terminals 32 and 34 of the contactor are positioned one to engage electrical contact A and one to engage electrical contact B. Actuator 86 and push button 82 being acted on by spring 96 are shown in the at rest position and the actuator is fully displaced outwardly from the switch housing. Axle 42 about which carrier 40 is pivotably mounted is shown located within the axle slot and the carrier is shown rotated in the left direction. Cycler 60 is shown mounted to the leftmost portion of hook slot 86 and deflecting post 66 is shown placed in front of face 52 of deflecting block 50. Hence, it may be seen that all the components are positioned such that an "in" displacement of actuator 80 will cause cycler 60 including deflecting post 66 to be displaced in the "in" direction. As deflecting post 66 is displaced in the "in" direction, it contacts face 52 of deflecting block 50. The relative angle between the elliptical deflecting post and face 52 of the deflecting means causes the carrier to be rotated in the clockwise direction causing left to right motion of the various contacts. In this manner, as the actuator is pushed inwardly, terminal 34 is forced to the right over detent rib 26 until it is in engagement with electrical contact C as is shown in FIG. 4. Hence, the carrier has been caused to rotate as the actuator and the cycler are displaced inwardly.

Figure 5:
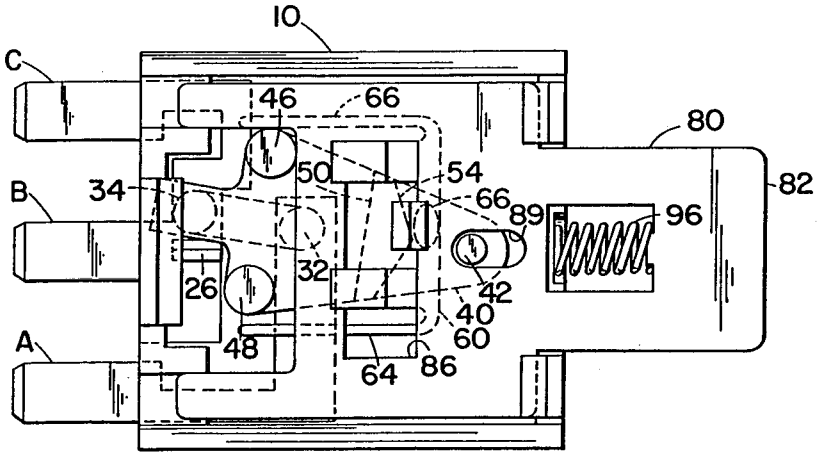
FIG. 5 is a partial top view of the switch in the second position at rest position.

Additionally, as the actuator and cycler are displaced inwardly, spring arm 66 of the cycler is displaced in the right direction by alignment post 46. This displacement causes a bias in the cycler which would cause the cycler to move in the right direction sliding within hook slot 86 except for the fact that the deflecting post engaging the deflecting block holds the cycler in position. Once the actuator button is released, spring 96 forces actuator 80 in the "out" direction thereby disengaging the deflecting post from the deflecting block. Once the deflecting post clears the deflecting block, the bias force applied by spring arm 62 against post 46 causes cycler 60 to be displaced in the right direction moving across the hook slot. This position is shown in FIG. 5 wherein the switch is shown in the at rest position with the terminal 34 being in the second position in contact with electrical contact C. It is noted that the cycler has been moved to the rightmost portion of hook slot 86, and as now positioned, the deflecting post will engage face 54 of the deflecting block upon inward displacement.

Figure 6:
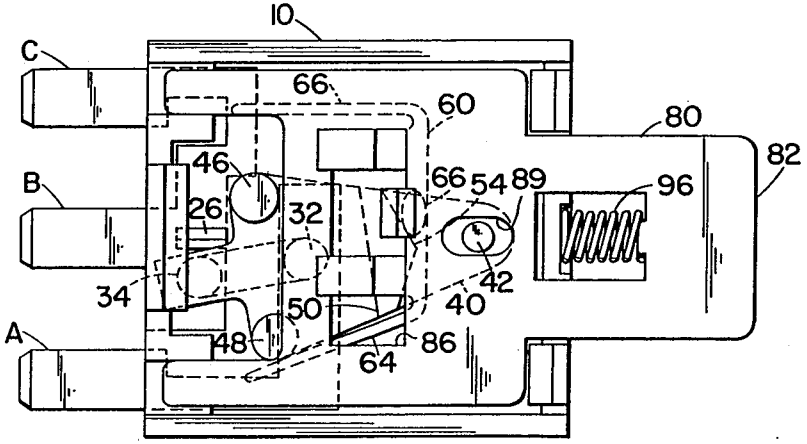
FIG. 6 is a partial top view of the switch in the second position full-in position.

FIG. 6 shows the switch being placed in the full-in position which has caused terminal 34 to be displaced back into electrical engagement with contact B. Moving from the position of FIG. 5 to the position as shown in FIG. 6, again the actuator is displaced inwardly compressing spring 96 and forcing cycler 66 inwardly thereby contacting deflecting post 66 with face 54 of deflecting block 50 causing the carrier to rotate in a counterclockwise direction causing terminal 34 to move in a left direction across detent rib 26. In this manner, the switch changes state back to the first position. Also it is to be noted that spring arm 64 is displaced by alignment post 44 creating a bias to urge the cycler back to the leftmost position within the hook slot. Once the actuator is released, the cycler will slide within the hook slot to the leftmost position back to the position shown in FIG. 3. Hence, in this manner it may be seen that by each displacement of the actuator it is possible to change the position of the switch. It also can be seen that in-out displacement of push button 82 of actuator 80 causes in-out displacement of cycler 60 and left-right displacement of cycler 60 at appropriate times. Additionally, the displacement of the cycler 60 acts to cause carrier 40 to be rotated causing left-right displacement of terminal 34 to effect switching between the electrical contacts. Hence, the three moving components each have a different displacement pattern. The actuator moves merely in the in-out direction and the carrier moves merely in a rotational direction. The cycler moves both in an in-out direction and a left-right direction. The purpose of moving the cycler in the left-right direction is to allow the deflecting post to be positioned to contact the faces of the deflecting blocks separately to cause rotation of the carrier in opposite directions.

The invention has been described with reference to a particular embodiment, however, it is to be understood by those skilled in the art that variations and modifications can be effected within the spirit and scope of the herein invention.

I claim:

1. A push-push type switch which comprises:

a housing including a bottom portion with electrical contacts separated by a detent rib;

a contactor mounted to a carrier for making electrical connections with the contacts, said contactor having a terminal which is located on one side of the detent rib when the switch is in a first position and the other side of the detent rib when the switch is in a second position;

wherein said carrier includes an axle mounted to the housing to secure the carrier for rotational movement, a deflecting means including at least one face angled from a radius extending from the axle and extending alignment post means spaced from the axle;

a cycler mounted within the housing and including an extending deflecting post positioned to engage the deflecting means of the carrier as the cycler is displaced causing the carrier to rotate about the axle and the contactor to traverse the detent rib to be displaced between the first position and the second position; and an actuator mounted for sliding movement and including biasing means for urging the actuator to its at rest position, said actuator including a push button and defining a slot for the receipt of the cycler, whereby displacement of the actuator causes displacement of the cycler.

2. The apparatus as set forth in claim 1 wherein the deflecting means includes at least two faces angled from a radius extending from the axle and wherein the deflecting post engages one face as the cycler is displaced to displace the contactor from the first position to the second position and the other face to displace the contactor from the second position to the first position.

3. The apparatus as set forth in claim 2 and further comprising means for offsetting the carrier between subsequent sliding motions of the actuator such that the deflecting means is displaced to allow the deflecting post to contact different faces of the deflecting means upon sequential sliding displacement of the actuator.

4. The apparatus as set forth in claim 3 and further comprising the actuator defining a slot of sufficient size to allow the cycler to be offset relative to the actuator in a direction different than the motion of the actuator and the cycler including means for mounting the cycler to the actuator to cause the cycler to be displaced with the motion of the actuator and to be offset relative to the actuator in a direction different than the motion of the actuator.

5. The apparatus as set forth in claim 3 wherein the means for offsetting includes a pair of spring arms extending from either side of the cycler, said spring arms being positioned to be displaced by the alignment post means upon rotation of the carrier to create a bias force for offsetting the cycler.

6. The apparatus as set forth in claim 1 wherein the deflecting post is ellipitical in cross section.

7. The apparatus as set forth in claim 1 and further comprising a second push-push type switch positioned adjacent the push-push type switch and pushrod means extending between the switches to effect cross cancelling therebetween.

8. A push-push type switch which is operated with a small manual displacement and which provides the operator with tactile feedback, including a housing and fixed contacts which comprises:

an actuator including a push button mounted relative to the housing for in-out sliding displacement;

a cycler mounted to the actuator for in-out sliding displacement with the actuator and being slidably mounted to allow left-right sliding displacement relative to the actuator;

a carrier mounted to the housing for rotational displacement between a first position and a second position, said carrier including deflecting means having a pair of faces each angled from the in-out displacement direction and a contactor having at least one contact which engages the fixed contact in at least one position; and said cycler including a deflecting post for engaging one face of the deflecting means upon a sliding displacement of the actuator, said motion causing the carrier to rotate from a first position to a second position.

9. The apparatus as set forth in claim 8 and further comprising when the deflecting post contacts the other of said faces, the carrier is caused to rotate from the second position to the first position.

10. The apparatus as set forth in claim 9 wherein the carrier further comprises extending alignment posts and wherein the cycler further comprises a spring arm extending from either side of the cycler to engage the alignment posts such that upon rotation of the carrier a spring arm is displaced by an alignment post creating a biasing force which acts to displace the cycler in the left-right sliding direction after the deflecting post disengages from the deflecting means.

11. The apparatus as set forth in claim 8 wherein the housing includes a detent rib and wherein when the carrier is displaced from the first position to the second position, the contact is displaced crossing the detent rib which action provides tactile feedback to the operator.

12. The apparatus as set forth in claim 8 wherein the deflecting post is elliptical in cross section.

13. A low displacement push-push type switch which comprises:

a housing having a fixed electrical contact;

an actuator including a push button mounted for low displacement in-out sliding motion within the housing;

a contactor including a second electrical contact mounted to a carrier for being displaced in a left-right direction across a detent to effect movement between a first position and a second position at which the first electrical contact engages the second electrical contact; and means for translating low displacement in-out motion of the actuator to larger displacement left-right motion of the contactor to effect switching, said means allowing for tactile feedback to the operator while allowing for low displacement in-out motion; and wherein the carrier is mounted to the housing for rotational movement wherein the carrier includes deflecting means having contact faces angled in opposite directions from the in-out motion and wherein a cylcer is mounted to the actuator and includes an elliptical cross section deflecting post positioned to engage on the faces of the deflecting means to translate in-out displacement of the actuator to rotation of the carrier causing left-right displacement of the contactor.

14. The apparatus as set forth in claim 13 wherein the cycler is mounted to the actuator for left-right sliding motion and further comprising biasing means to cause the cycler to be displaced in the left-right direction to allow the deflecting post to contact one of the faces of the deflecting means, the direction of rotation of the carrier and the displacement of the contactor depending upon which face is contacted.

15. The apparatus as set forth in claim 14 wherein the biasing means further comprises alignment posts extending from the carrier and spring arms extending from the cycer, said spring arms contacting the alignment posts such that the spring arms are displaced with the carrier causing a biasing force to be applied to the cycler to effect left-right sliding motion of the cycler.

16. The apparatus as set forth in claim 15 wherein the housing comprises electrical contacts located on either side of the detent together with a common contact and wherein the contactor in the first position engages the common contact and one electrical contact and in the other position engages the common contact and the other electrical contact.

17. The apparatus as set forth in claim 13 and further comprising a second push-push type switch positioned adjacent the low displacement push-push type switch and a connecting means extending between the second push-push type switch and the low displacement push-push type switch to effect cross cancelling therebetween.

* * * * *